US006742192B1

(12) United States Patent
Song

(10) Patent No.: US 6,742,192 B1
(45) Date of Patent: Jun. 1, 2004

(54) AIR MASK FOR A HELMET OF MOTORCYCLES

(75) Inventor: Yea-Ho Song, Yongin-si (KR)

(73) Assignee: Jtech Co., Ltd., Kyunggi-do (KR)

( * ) Notice: Subject to any disclaimer, the term of this patent is extended or adjusted under 35 U.S.C. 154(b) by 10 days.

(21) Appl. No.: 10/331,129

(22) Filed: Dec. 27, 2002

(30) Foreign Application Priority Data

Nov. 25, 2002 (KR) ..... 2002-0073356

(51) Int. Cl.[7] ..... A42B 1/24; A42B 1/08
(52) U.S. Cl. ..... 2/422; 2/424
(58) Field of Search ..... 2/422, 424, 425, 2/171.3, 171.4, 436, 437

(56) References Cited

U.S. PATENT DOCUMENTS

| | | | | | |
|---|---|---|---|---|---|
| 3,311,922 | A | * | 4/1967 | Bezzerides | 2/8 |
| 4,556,994 | A | * | 12/1985 | Kawasaki et al. | 2/424 |
| 4,667,348 | A | * | 5/1987 | Sundahl | 2/424 |
| 4,729,132 | A | * | 3/1988 | Fierro | 2/171.4 |
| 5,161,261 | A | * | 11/1992 | Kamata | 2/424 |
| 5,349,949 | A | * | 9/1994 | Schegerin | 128/206.24 |
| 5,797,146 | A | * | 8/1998 | Matich | 2/424 |
| 6,417,491 | B1 | * | 7/2002 | Taniuchi | 2/424 |

FOREIGN PATENT DOCUMENTS

| | | | | | |
|---|---|---|---|---|---|
| EP | 97285 | A2 | * | 1/1984 | A42B/3/00 |
| GB | 1576647 | | * | 10/1980 | |
| GB | 2133971 | A | * | 8/1984 | A42B/3/00 |
| JP | 03051306 | A | * | 3/1991 | A42B/3/24 |
| JP | 10110321 | A | * | 4/1998 | A42B/3/24 |

* cited by examiner

*Primary Examiner*—Rodney M. Lindsey
(74) *Attorney, Agent, or Firm*—R. Neil Sudol; Henry D. Coleman; William J. Sapone

(57) ABSTRACT

The present invention relates to an air mask for a helmet of a motorcycle which is selectively detachable by a user of a helmet for protecting a user's head when a user rides a motorcycle, snowmobile, bicycle, etc. The air mask includes a mask body which is engaged to an engaging jaw formed in an upper portion of a jaw protection member of a helmet and is formed of a semicircular flexible plastic material and includes a melting portion in which an engaging member is integrally and downwardly bent in an outer circumferential surface of the same, and a center portion of the same is bent in a certain shape in an inner side of the same; and an air shielding member which includes a contact portion which is formed of an elastic flexible rubber material and is bent in the same shape as a human face in order for being closely contacted with a human face in a horizontal direction, and an end portion of the same is inwardly rolled, wherein the other portion of the same is bent in a certain shape corresponding to a melting portion of the mask body and is heat-molten and bonded to the melting portion of the mask body, and a nose portion is bent to a center portion of the same.

1 Claim, 3 Drawing Sheets

【Fig.1】 Prior Art
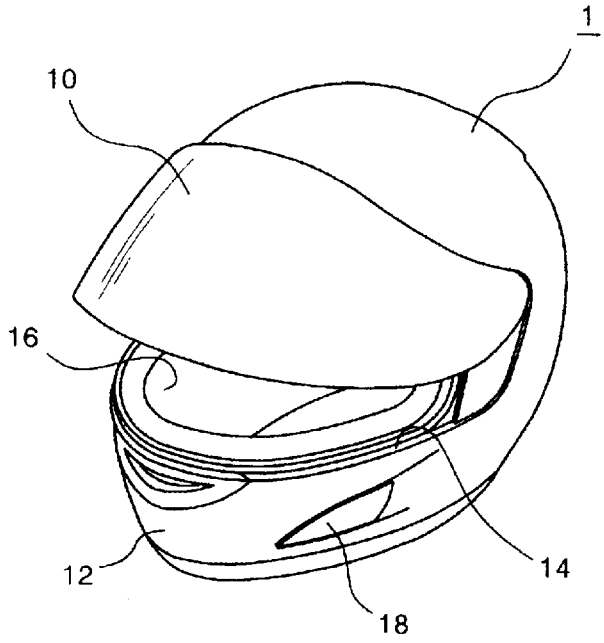
【Fig.2】
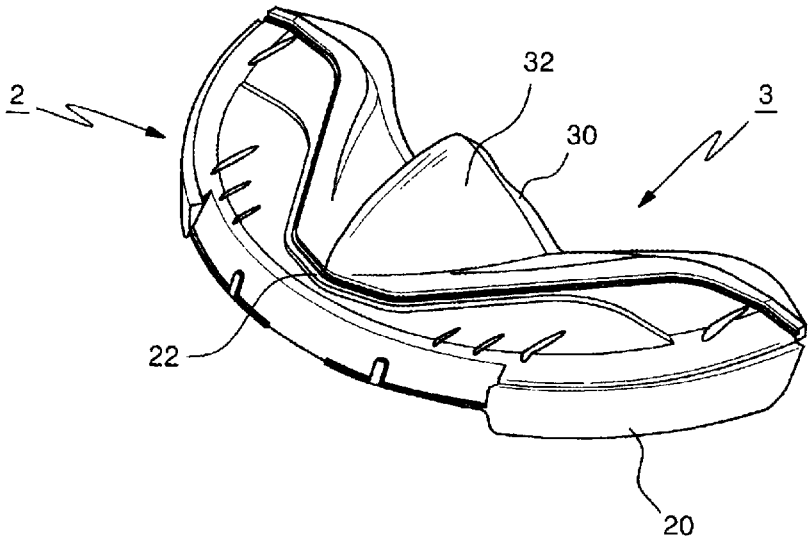

【Fig.3】
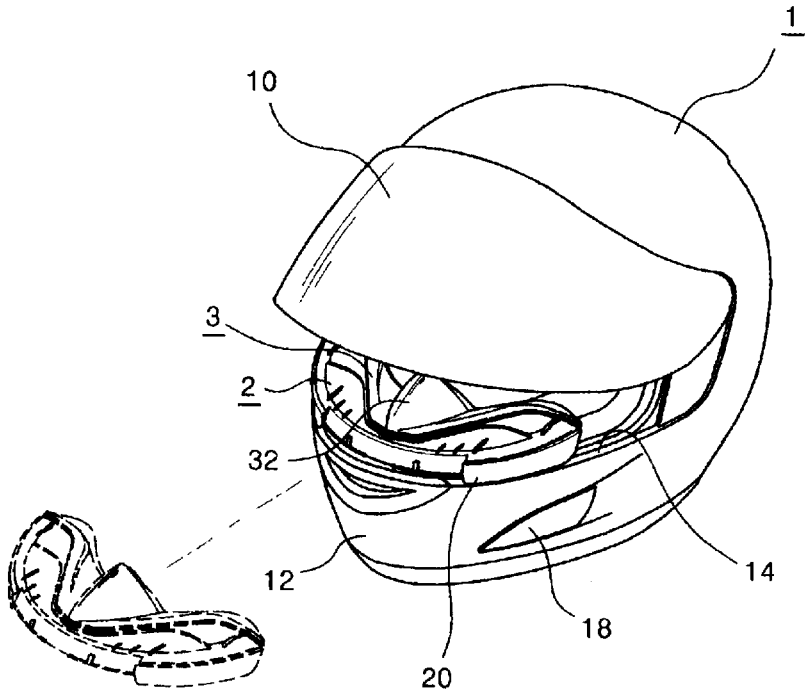
【Fig.4】
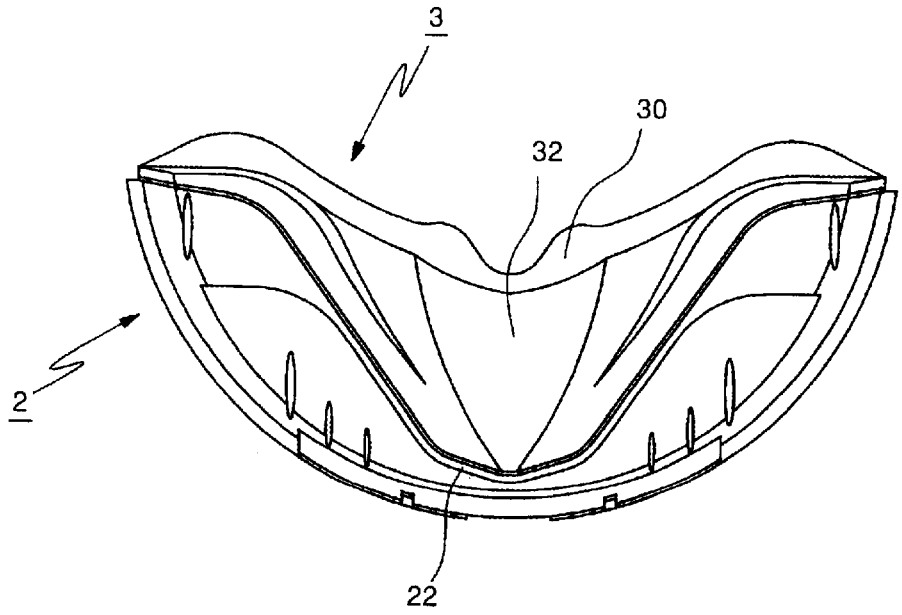

【Fig.5】
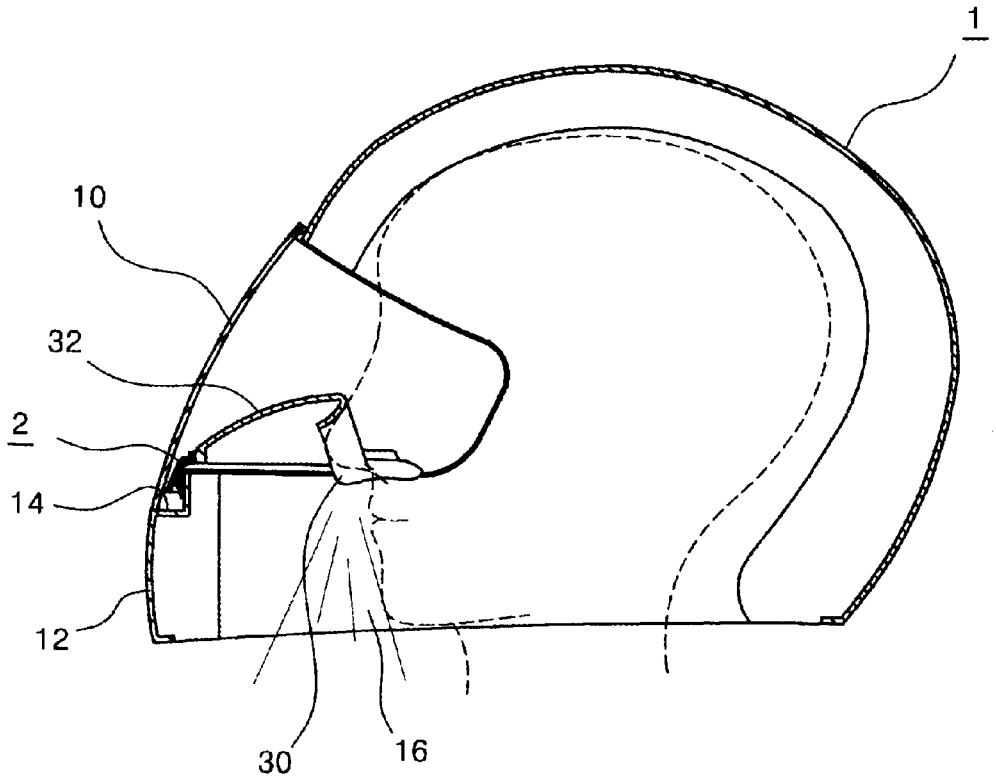

AIR MASK FOR A HELMET OF MOTORCYCLES

BACKGROUND OF THE INVENTION

1. Field of the Invention

The present invention relates to an air mask for a helmet of a motorcycle which is selectively detachable by a user of a helmet for protecting a user's head when a user rides a motorcycle, snowmobile, bicycle, etc., and in particular to an air mask for a helmet of a motorcycle which is capable of effectively preventing a wind blown from the outside when running in a forward direction in a state that a helmet is worn and preventing a steam in an inner side of a helmet due to a mouth breath or nose breath by selectively installing a mask formed of a flexible synthetic resin material in an upper side of a jaw protection member to which a light penetration shield of a helmet is installed, thereby implementing a wide range of vision when a motorcycle runs in a forward direction.

2. Description of the Background Art

When a two-wheel vehicle like a motorcycle runs, it is required to wear a helmet for protecting a user's head based on the traffic law.

In addition, the above helmet is fabricated in such a manner that a forwardly blowing wind and light are prevented when a motorcycle runs in a forward direction, thereby implementing a good range of vision. In addition, a shield that opens and closes in an upward and downward direction is installed in the helmet in order for the user to breath properly.

As shown in FIG. 1, in the conventional helmet, the shield is opened and closed in a front portion of the helmet.

The above construction of the shield will be described in detail.

There is provided a semi-circular helmet 1. A face portion 16 is opened in front of the helmet 1 thereby implementing a desired range of vision when wearing a helmet. A light penetration shield 10 is installed at both sides of a body of a helmet based on an opening and closing operation in an upward and downward direction for preventing a wind blown in the direction of the face portion 16 and light coming in the same direction, so that the face portion 16 is selectively closed or opened.

In addition, a jaw protection member 12 is integrally formed with the helmet 1 in a lower portion of the opened face portion 16, thereby protecting a user's jaw when a user wears the helmet. An air flow port 18 is formed in a front portion of the jaw protection member 12 in such a manner that the air flow port 18 connects with the interior of the helmet thereby flowing an external air into the interior of the helmet.

Therefore, in the thusly constituted helmet for a motorcycle, when a user wears and closes the face portion through the shield when a motorcycle runs, the forward range of vision is obtained in cooperation with the shield, and it is possible to prevent the air flowing into the interior of the helmet when the motorcycle runs at a high speed, thereby implementing a safety operation of the motorcycle.

However, in the conventional helmet for a motorcycle, when a user wears the helmet and runs the motorcycle, it is possible to prevent a forward wind which is blown in a forward direction of the helmet when the motorcycle runs, but it is impossible to prevent a wind which is blown from the lower portion of the helmet, namely, from the lower portion of the jaw protection member in a state that the user wears the helmet. In particular, in the winter season, a steam may be formed in the inner surfaces of the shield due to a difference of the temperatures between the inside and the outside of the helmet according to the forward wind thereby decreasing a range of vision.

Furthermore, when a user wears a helmet and run's the motorcycle, the steam may be formed in the inner surfaces of the shield due to a user's breath through a mouth and a nose.

SUMMARY OF THE INVENTION

Accordingly, the present invention provides an air mask for a helmet of a motorcycle that overcomes the problems encountered in the conventional art.

It is an object of the present invention to provide an air mask for a helmet of a motorcycle which is capable of effectively preventing a forward wind which is blown from the outside by closely contacting a mask to a face of the user by selectively installing a mask formed of a flexible synthetic resin material in an upper surface of the jaw protection member to which a light penetration shield of a helmet is installed and preventing a steam on the inner surfaces of the shield due to a mouth breath or nose breath, for thereby implementing a good range of vision when a motorcycle runs in the forward direction.

In order to achieve the above objects, there is provided an air mask for a helmet of a motorcycle which includes a mask body which is engaged to an engaging jaw formed in an upper portion of a jaw protection member of a helmet and is formed of a semicircular flexible plastic material and includes a melting portion in which an engaging member is integrally and downwardly bent in an outer circumferential surface of the same, and a center portion of the same is bent in a certain shape in an inner side of the same; and an air shielding member which includes a contact portion which is formed of an elastic flexible rubber material and is bent in the same shape as a human face in order for being closely contacted with a human face in a horizontal direction, and an end portion of the same is inwardly rolled, wherein the other portion of the same is bent in a certain shape corresponding to a melting portion of the mask body and is heat-molten and bonded to the melting portion of the mask body, and a nose portion is bent to a center portion of the same.

BRIEF DESCRIPTION OF THE DRAWINGS

The present invention will become better understood with reference to the accompanying drawings which are given only by way of illustration and thus are not limitative of the present invention, wherein;

FIG. 1 is a perspective view illustrating a conventional helmet for a motorcycle;

FIG. 2 is a perspective view illustrating an air mask for a helmet of a motorcycle according to the present invention;

FIG. 3 is a perspective view illustrating an installation state of an air mask according to the present invention;

FIG. 4 is a plane view illustrating an air mask according to the present invention; and FIG. 5 is a schematic side view illustrating an inner construction when an air mask is worn by a user according to the present invention.

DESCRIPTION ON MAJOR ELEMENTS OF THE DRAWINGS

| | |
|---|---|
| 1: helmet | 2: mask body |
| 3: air shielding member | 10: light penetration shield |
| 12: jaw protection member | 14: engaging jaw |
| 16: face portion | 18: air flow port |
| 20: engaging member | 22: melting portion |
| 30: contact portion | 32: nose portion |

DETAILED DESCRIPTION OF THE PREFERRED EMBODIMENTS

The constructions and operations of the present invention will be explained with reference to the accompanying drawings.

The same elements as the conventional constructions will be given the same reference numerals in the description of the present invention. FIG. 2 is a perspective view illustrating an air mask for a helmet for a motorcycle according to the present invention. FIG. 3 is a perspective view illustrating an installation state of an air mask according to the present invention, and FIG. 4 is a plane view illustrating an air mask according to the present invention. The air mask according to the present invention includes a mask body 2 which is installed in an upper portion of a jaw protection member 12 of a helmet 1 and is formed of a flexible plastic material, and an air shielding member 3 which is heat-bonded to an inner side of the mask body 2 and is formed of an elastic rubber material.

Here, the mask body 2 is engaged to an engaging jaw 14 formed in an upper portion of the jaw protection member 12 of the helmet 1 and is formed in a semi-circular shape, and an engaging member 20 is downwardly bent in an outer circumferential surface of the same.

The above mask body 2 is formed of a flexible plastic material and is elastically flexible depending on a curvature of an arc of an upper surface of the jaw protection member 12 of the helmet 1.

In addition, a melting portion 22 is formed in an inner side of the mask body 2 in such a manner that a center portion of the same is bent in a certain shape, and a part of the air shielding member 3 is heat-molten and bonded thereto.

Next, the air shielding member 3 heat-molten to an inner side of the mask body 2 is formed of a flexible and elastic rubber material and is formed in the same shape as a human face in such a manner that the air shielding member 3 closely contacts with a user's face in a horizontal direction. In addition, a contact portion 30 is formed therein in such a manner that an end portion of the same is inwardly rolled as shown in FIG. 4.

In addition, the other end of the air shielding member 3 is bent in a certain shape corresponding to the melting portion 22 of the mask body 2 and is heat-molten and bonded to the melting portion 22 of the mask body 2.

A nose portion 32 is bent and formed in a center portion of the air shielding member 3. In the case that the air mask according to the present invention is installed in the helmet 1, and the helmet is worn by the user, the nose portion 32 is closely contacted with a user's face.

The function and effect of the present invention will be provided with respect to the following description accompanying the drawings.

As shown in FIGS. 2 and 3, compared to the conventional helmet 1 in which the jaw protection member 12 is integrally formed, and the face portion 16 is opened and closed based on the light penetration shield 10, in the present invention, an engaging jaw 14 is formed in an upper portion of the jaw protection member 12 of the helmet 1 in order for the lower portion of the light penetration shield 10 to closely contact with the upper portion of the jaw protection member 12 when closing the face portion 16 by downwardly rotating the light penetration shield 10.

Namely, in the present invention, the mask body 2 is engaged to the engaging jaw 14 formed in an upper portion of the jaw protection member 12 of the helmet 1. In a state that a helmet user opens the light penetration shield 10 and then wears the helmet 1, the engaging member 20 integrally formed in an outer lower portion of the mask body 2 is engaged to the engaging jaw 14 of the upper portion of the jaw protection member 12 of the helmet 1.

Here, since the mask body 2 is formed of a flexible plastic material, the mask body 2 is effectively engaged based on a curvature of an arc of the engaging jaw 14 of the upper portion of the jaw protection member 12 of the helmet 1.

Continuously, in a state that the air mask according to the present invention is engaged to an upper portion of the jaw protection member 12, when the opened light penetration shield 10 is downwardly rotated thereby closing the face portion 16, the mask body 2 is fixed to an upper portion of the jaw protection member 12 by the light penetration shield 10.

FIG. 5 is a schematic side view in which an air mask body is fixed by a light penetration shield in a state that a helmet is worn. In a state that the air mask according to the present invention is engaged to an upper portion of the jaw protection member 12 of the helmet 1, when the face portion 16is closed by rotating the light penetration shield 10, the engaging member 20 of the mask body 2 is engaged between the lower portion of the closed light penetration shield 10 and the engaging jaw 14 of the upper portion of the jaw protection member 12, so that the air mask is effectively fixed.

When the mask body 2 is fixed to an upper portion of the jaw protection member 12 of the helmet 1 in the above manner, the air shielding member 3 which is heat-molted and bonded to the inner side of the mask body 2 is closely contacted with a user's face for thereby effectively shielding an external air.

In particular, as shown in FIG. 4, since the air shielding member 3 is bent in the same shape as a human face in order for the contact portion 30 formed of an elastic rubber material in one end of the same to closely contact with the human face in a horizontal direction, and the end portion of the same is inwardly rolled, so that it is closely contacted with a user's face. In addition, since the nose portion 32 is formed in the center portion in such a manner that the nose portion is closely contact with a user's nose portion as shown in FIGS. 2 to 5.

Therefore, when the air mask according to the present invention is closely contacted with the upper portion of the jaw protection member 12 of the helmet 1 by the light penetration shield 10, the air shielding member 3 formed in the inner side of the same is closely contacted with a face portion with respect to the nose portion of the user. Therefore, in a state that the helmet is worn, it is possible to prevent breath steam or nose steam from being moved in a direction of the upper portion of the mask, namely, into the interior of the light penetration shield which is adapted to implement a good range of vision. In addition, it is possible to prevent a steam formation in the inner surfaces of the light penetration shield by preventing a forward wind which is blown from the outside when the motorcycle runs.

In addition, when a user rides a motorcycle and runs at a high speed, it is possible to effectively prevent a wind noise due to a forward wind, so that it is possible to implement a stable state of the user thereby implementing a desired safety.

As described above, in the air mask for a helmet of a motorcycle according to the present invention, the air mask is detachable to a conventional helmet of the motorcycle. In a state that the air mask according to the present invention is engaged to the helmet, the air shielding member formed in the inner side is closely contacted with the face portion with respect to the nose ridge. Therefore, in a state that the helmet is worn, it is possible to prevent a mouth breath steam or nose steam from being moved in a direction of the upper portion of the mask, namely, into the interior of the light penetration shield which is adapted to implement a desired range of vision. In addition, it is possible to prevent a forward wind which is blown from the outside when the motorcycle runs, so that it is possible to prevent a steam formation in the inner surfaces of the light penetration shield.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An air mask for a helmet of a motorcycle, comprising:

a mask body which is engaged to an engaging jaw formed in an upper portion of a jaw protection member of a helmet and is formed of a semicircular flexible plastic material and includes a melting portion in which an engaging member is integrally and downwardly bent in an outer circumferential surface of the same, and a center portion of the same is bent in a certain shape in an inner side of the same; and an air shielding member which includes a contact portion which is formed of an elastic flexible rubber material and is bent in the same shape as a human face in order for being closely contacted with a human face in a horizontal direction, and an end portion of the same is inwardly rolled, wherein the other portion of the same is bent in a certain shape corresponding to a melting portion of the mask body and is heat-molten and bonded to the melting portion of the mask body, and a nose portion is bent to a center portion of the same.

* * * * *